US008663813B2

(12) United States Patent
Biris et al.

(10) Patent No.: US 8,663,813 B2
(45) Date of Patent: Mar. 4, 2014

(54) SEAMLESS COMPOSITE METAL TUBE AND METHOD OF MANUFACTURING THE SAME

(75) Inventors: John Biris, Kifissia (GR); George Hinopoulos, Kifissia (GR); Apostolos Kaimenopoulos, Pefki (GR)

(73) Assignee: Halcor Metal Works S.A., Athens (GR)

( * ) Notice: Subject to any disclaimer, the term of this patent is extended or adjusted under 35 U.S.C. 154(b) by 273 days.

(21) Appl. No.: 13/061,093

(22) PCT Filed: Mar. 31, 2010

(86) PCT No.: PCT/EP2010/054324

§ 371 (c)(1),
(2), (4) Date: Aug. 10, 2011

(87) PCT Pub. No.: WO2011/120574

PCT Pub. Date: Oct. 6, 2011

(65) Prior Publication Data

US 2011/0290364 A1 Dec. 1, 2011

(51) Int. Cl.

| | |
|---|---|
| ***B32B 15/02*** | (2006.01) |
| ***B32B 1/08*** | (2006.01) |
| ***B32B 15/20*** | (2006.01) |
| ***B21C 23/22*** | (2006.01) |
| ***F16L 9/02*** | (2006.01) |

(52) U.S. Cl.

USPC ..... 428/610; 428/652; 148/521; 72/47; 72/253.1; 228/126; 228/193; 138/143

(58) Field of Classification Search

None

See application file for complete search history.

(56) References Cited

U.S. PATENT DOCUMENTS

| | | | | | |
|---|---|---|---|---|---|
| 2,823,933 | A | * | 2/1958 | Hickman et al. | 285/148.12 |
| 2,977,675 | A | * | 4/1961 | Simms | 219/137 R |
| 3,042,428 | A | * | 7/1962 | Gardiner | 285/148.12 |
| 3,900,695 | A | * | 8/1975 | Andersson et al. | 373/152 |
| 4,013,211 | A | * | 3/1977 | Atman | 228/126 |
| 5,223,349 | A | * | 6/1993 | Kudo et al. | 428/652 |
| 5,549,335 | A | * | 8/1996 | Wohrstein | 285/288.1 |
| 8,365,568 | B2 | * | 2/2013 | Biris et al. | 72/258 |
| 2007/0151719 | A1 | * | 7/2007 | Minami et al. | 165/180 |
| 2009/0308481 | A1 | | 12/2009 | Xiao | 138/142 |

FOREIGN PATENT DOCUMENTS

| | | | |
|---|---|---|---|
| DE | 2052462 | * | 10/1975 |
| EP | 0 894 547 | | 2/1999 |
| JP | 61-119996 | * | 6/1986 |
| JP | 61 119996 | | 6/1986 |
| JP | 61-270579 | * | 11/1986 |
| JP | 62-44567 | * | 2/1987 |
| JP | 10 054692 | | 2/1998 |
| JP | 2000 210713 | | 8/2000 |
| JP | 2006-264198 | * | 10/2006 |
| WO | 2008/128571 | | 10/2008 |

OTHER PUBLICATIONS

Machine translation of JP 2000-210713. Aug. 2000.*
Abstract for CN 1932361. Mar. 2007.*

(Continued)

*Primary Examiner* — John J Zimmerman
(74) *Attorney, Agent, or Firm* — Ladas & Parry, LLP

(57) ABSTRACT

A seamless composite metal tube comprises an inner layer (1) consisting of copper or a copper alloy, an outer layer (5) consisting of aluminium or an aluminium alloy, and at least three different intermediate intermetallic layers (2, 3, 4) each consisting of copper and aluminium, wherein the concentration of copper decreases from the inner layer (1) to the outer layer (5) in the radial direction of the tube.

19 Claims, 9 Drawing Sheets

(56) References Cited

OTHER PUBLICATIONS

Abstract for CN 101241775. Aug. 2008.*
Abstract for CN 201281570. Jul. 2009.*
Abstract for CN 201352034. Nov. 2009.*
Abstract for CN 101767123. Jul. 2010.*
PCT International Search Report and Written for PCT/EP2010/054324 dated Dec. 22, 2010 (9 pages).
PCT International Preliminary Examination Report for PCT/EP2010/054324 dated Oct. 2, 2012 (6 pages).

* cited by examiner

SEAMLESS COMPOSITE METAL TUBE AND METHOD OF MANUFACTURING THE SAME

CROSS-REFERENCE TO RELATED APPLICATIONS

This application is the U.S. National Stage of International Patent Application No. PCT/EP2010/054324 filed on Mar. 31, 2010 and which claims priority thereto, disclosures of which is hereby incorporated by reference in its entirety.

The present invention relates to a seamless composite metal tube and a method of manufacturing the same.

Composite multilayer tubes comprising an inner layer made of copper and an outer layer made of aluminum (referred to Cu—Al-composite tube) are known from the prior art.

E.g. JP-A-6111996 teaches to produce a Cu—Al-composite tube by cold drawing (through dies or reduction rolls) a tube made of aluminum placed over a tube made of copper, with both tubes having been manufactured separately beforehand. However, for some applications, e.g. the bonding strength between the aluminum layer and the copper layer of the Cu—Al-composite produced according to this manufacturing method is not sufficient.

It is the object of the present invention to provide a composite tube having improved characteristics and to provide a method of manufacturing such tube.

The object of the invention is achieved with a seamless composite metal tube and a method of manufacturing a seamless composite metal tube according to the independent claims.

Further advantageous developments of the invention are subject-matter of the dependent claims.

According to the invention, a seamless composite metal tube comprises an inner layer (inner tube) consisting of copper or a copper alloy, an outer layer (outer tube) consisting of aluminum or an aluminum alloy, and at least three different intermediate intermetallic layers each consisting of copper and aluminum. The concentration of copper decreases from the inner layer to the outer layer in the radial direction of the tube (and accordingly the concentration of aluminum increases from the inner layer to the outer layer in the radial direction of the tube). Specifically, there is a discrete concentration step between each layer of the composite metal tube.

The at least three intermediate intermetallic layers act as strong bonds between the inner layer and the outer layer. In particular, the presence of the at least three intermediate intermetallic layers leads to a decrease of tensions and tension peaks, respectively, between the inner layer and the outer layer. As a result, the composite metal tube exhibits an excellent bonding strength between the inner and the outer layer. Apart from that, due to the intermetallic layers, the composite metal tube shows a superior thermal resistance, especially when the tube is subjected to high variations in temperature, as e.g. in HVAC (heating, ventilation, air conditioning) applications. Accordingly, durability and lifetime of the composite metal tube are improved. Further, a mechanical workability of the composite metal tube is improved.

Preferably, the inner intermediate intermetallic layer comprises 79-85 wt % of copper and 21-15 wt % of aluminum, the middle intermediate intermetallic layer comprises 69-63 wt % of copper and 31-27 wt % of aluminum, and the outer intermediate intermetallic layer comprises 50-55 wt % of copper and 50-45 wt % of aluminum. In these ranges, an excellent bonding strength between the outer layer and the inner layer is achieved.

Preferably, the inner intermediate intermetallic layer consists of copper and aluminum being in the γ-phase, the middle intermediate intermetallic layer consists of copper and aluminum being in the η-phase, and the outer intermediate intermetallic layer consists of copper and aluminum being in the θ-phase. The provision of the intermediate intermetallic layers with copper and aluminum being in each layer in a different phase leads to an increased bonding strength between the outer aluminum layer and the inner copper layer of the tube.

Preferably, each of the intermediate intermetallic layers has a thickness in the radial direction of the tube between 0.5 μm to 4.0 μm. Preferably, the sum of the thicknesses of the intermediate intermetallic layers in the radial direction of the tube is between 1.5 μm to 12 μm. In this ranges an optimum bonding strength is achievable.

Preferably, the inner layer has a thickness in the radial direction of the tube between 0.1 to 5 mm. Preferably the outer layer has a thickness in the radial direction of the tube between 0.1 to 5 mm.

Preferably, the thickness of the outer intermediate intermetallic layer is at least twice as much as the thickness of the inner intermediate intermetallic layer in the radial direction of the tube. Due to the outer intermediate intermetallic layer being relatively large compared to the inner intermediate intermetallic layer, the bonding strength can be further increased.

Preferably, the inner layer comprises 99.90 wt % or more of copper, and the outer layer comprises 99.50 wt % or more of aluminum.

Advantageously, the thickness ratio of the inner layer and the outer layer in the radial direction of the tube is between 0.1 and 0.8.

The method of manufacturing a seamless composite metal tube according to the invention comprises the steps of a) heat-activating the outer surface of a seamless tube made of copper or a copper alloy, and
b) extruding a tubular layer of aluminum or an aluminum alloy directly onto the heat-activated outer surface of the seamless tube made of copper or a copper alloy thereby producing a seamless composite metal tube.

The heat-activating of the outer surface of the seamless tube has the effect that the diffusion of aluminum atoms into the copper is promoted. The extrusion of the tubular layer of aluminum or an aluminum alloy directly onto the heat-activated outer surface of the seamless tube results in the forming of at least three intermediate intermetallic layers between the inner tube made of copper or a copper alloy and the tubular layer of aluminum or an aluminum alloy. Specifically, the formation of the at least three intermediate intermetallic layers (one after another) starts immediately after the extrusion material coming into contact with the heat-activated outer surface of the copper tube.

As a result, it is possible to produce with the method of the invention a seamless composite metal tube as described above, in particular a seamless composite metal tube comprising an inner layer consisting of copper or a copper alloy, an outer layer consisting of aluminum or an aluminum alloy, and at least three different intermediate intermetallic layers each consisting of copper and aluminum, wherein the concentration of copper decreases from the inner layer to the outer layer in the radial direction of the composite metal tube.

Accordingly, the method of the invention enables to produce a composite metal tube having at least three different intermediate intermetallic layers, and, thus to produce a Cu—Al-composite tube exhibiting a high bonding strength between outer copper layer and the inner aluminum layer.

Apart from that, the method according to the invention provides the following advantages:

- The method is simple, involves few steps and avoids complicated precision operations such as wrapping and welding, or melting and casting, resulting in significant reductions of production costs.
- The method requires no welding step so that the produced composite metal tube does not show any material defects resulting from welding, and, thus, exhibits an improved adhesion between the inner copper layer and the outer aluminum layer.
- The thickness of the inner layer and the outer layer can be independently set and can be set within a wide range of values.

Preferably, the seamless tube is made of copper, i.e. comprises at least 99.90 wt % of copper. Alternatively, the seamless tube may be made of a copper alloy, such as e.g. CuFe2P. Preferably, the aluminum material to be extruded is aluminum, i.e. comprises at least 99.50 wt % of aluminum. Alternatively, it may be an aluminum alloy, such as e.g. an aluminum alloy of the 1000 series or 3000 series according to the designation of the Aluminum Association.

Preferably, step b) is performed by continuously passing the seamless tube made of copper or a copper alloy through an extrusion die and, at the same time, continuously extruding the tubular layer of aluminum or an aluminum alloy by means of the extrusion die onto the tube. This has the advantage that it is possible to continuously produce a seamless composite metal tube. I.e. composite metal tube can be produced in indefinite continuous lengths to suit any requirements.

Preferably, the tube made of copper or a copper alloy is heated to a temperature in a range from 350° to 450° C. This ensures an optimal diffusion of aluminum atoms into the copper tube, and, accordingly supports the formation of the at least three different intermediate intermetallic layers each having copper and aluminum in a different phase.

Preferably, the heat-activating is performed by induction heating under a protective atmosphere. Advantageously, this atmosphere is a nitrogen atmosphere. As a result of this configuration, corrosion of the copper tube and the produced composite tube can be avoided.

Preferably, the extrusion temperature of the aluminum or aluminum alloy (i.e. the temperature, at which the extruded aluminum material comes into contact with the outer surface of the seamless tube made of copper or a copper alloy) is set between 400° to 550° C. Because the extrusion temperature of the aluminum or aluminum alloy is set higher than the heat-activating temperature (350° to 450° C.) of the tube made of copper or a copper alloy (i.e. a temperature gradient exists between the copper tube and the aluminum material), a diffusion of aluminum atoms into the copper material is promoted, thereby promoting the formation of the at least three intermediate intermetallic layers each having copper and aluminum in a different phase, as described above.

Preferably, the method further comprises, subsequently to step b), the step c) of cooling the composite metal tube by forced convection. To this end, preferably a cooling tube is used which comprises internal fluid spray nozzles and/or fluid spray passages for spraying water onto the composite metal tube when it is passed through the interior of the cooling tube. Preferably, the composite metal tube is cooled down to below 80° C. The cooling stops a diffusion of aluminum atoms and copper atoms, respectively, leading to a stop of the formation/growing of the at least three intermediate intermetallic layers. By appropriately determining a cooling time/cooling rate, the desired number/thickness of the intermediate intermetallic layers can be set. Preferably, a cooling time is set in a range from 5 to 60 sec. By this setting a formation of at least three intermediate intermetallic layers is ensured. However, the cooling time can also be set shorter, because the formation of the intermetallic layers immediately starts when the extrusion material comes into contact with the outer surface of the copper tube. Preferably, a cooling rate is between 5 to 100° C./sec.

Preferably, the method further comprises, subsequently to step c), the step of passing the composite metal tube through a diameter reducing device or diameter and wall thickness reducing device for reducing its outer diameter or its outer diameter and wall thickness by a cold working. This cold working step enables to specifically set the properties of the composite metal tube, for example, the composite metal tube can be made more flexible or rigid, depending on the intensity of cold working.

Advantageously, the method comprises as the final step the step of coating the outer surface of the composite metal tube with an anticorrosive protection.

With the method according to the invention, the seamless composite metal tube can be produced in all standard sizes, e.g., for fluid transporting applications, such as HVAC&R applications (heat, ventilation, air-conditioning and refrigeration-application), as well as plumbing and heating installations. However, none-standard sizes can also be made to meet specific requirements, for example seamless composite metal tubes having an outside diameter from 6 to 32 mm and having a wall thickness of 0.25 to 2.0 mm can be produced. For example, a composite tube for heat exchanger application can be produced with a nominal outside diameter of 10 mm and a wall thickness of 0.5 mm, wherein the inner copper layer has a thickness of approximately 0.14 mm and the outer aluminum layer has a thickness of approximately 0.36 mm. Each of the three intermediate intermetallic layers has a thickness between 0.5 to 4.0 μm.

Preferably, the above described composite metal tube according to the invention is used in a heat-exchanger coil (preferably a heat-exchanger coil positioned on the outside of a building), wherein the heat-exchanger coil comprises fins made of aluminum, which are in contact with the composite metal tube. During use a heat-exchange medium (e.g. refrigerant) flows inside the composite metal tube. Since the composite metal tube according to the invention comprises an outer layer of aluminum, the aluminum fins are in contact with this outer aluminum layer only. Therefore, a contact corrosion (galvanic corrosion) leading to a degradation of the fins and finally to a destruction of the heat-exchanger coil can be prevented, which e.g. would occur if a tube completely consisting of copper is used instead of the composite metal tube according to the invention.

Preferably, the above described composite metal tube according to the invention is used in a flat solar absorber, wherein the flat solar absorber comprises the composite metal tube welded to an aluminum sheet. Solar rays heat up the aluminum sheet and the heat is transferred to the composite metal tube through the welding contact, thereby heating up a fluid, preferably water, flowing inside the tube. Because the composite metal tube according to the invention comprises an outer layer of aluminum, the aluminum sheet is in contact with this outer aluminum layer only. Accordingly, also in such an application a contact corrosion resulting from the contact of different materials can be prevented.

Preferably, the above described composite metal tube according to the invention is used as a connecting tube for air-conditioning systems enabling the connection of an outside heat-exchanger coil (as e.g. described above) with an inside heat-exchanger coil mounted inside a building, wherein during use an exchange medium (refrigerant) flows inside the connecting tube. The use of the above described composite metal tube according to the invention in such an application provides the following advantages: on the one hand, the inner copper layer provides a high corrosion resistance against chemical refrigerants usually used in such air-conditioning systems as well as sufficient flexibility and pressure resistance (resistance against pressure inside the tube). On the other hand, due to the outer aluminum layer, because of copper being more expensive than aluminum, the production costs for the composite metal tube can be lowered compared to a tube made completely of copper.

The invention will be described in more detail with respect to the drawings.

FIG. 1A is a schematic view showing the basic structure of the produced seamless composite metal tube right after an extrusion step.

FIG. 1B is an enlarged view schematically showing the diameter reduction by cold working of the produced seamless composite metal tube in a diameter reducing die.

Figure 3:
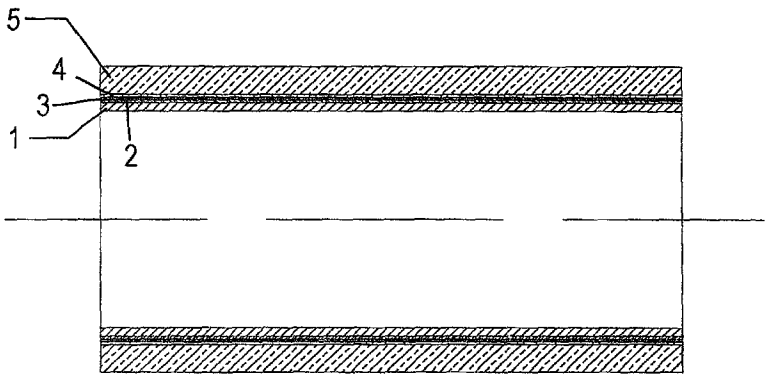

FIG. 3 schematically shows the basic structure of the seamless composite metal tube in a longitudinal section.

Figure 4A:
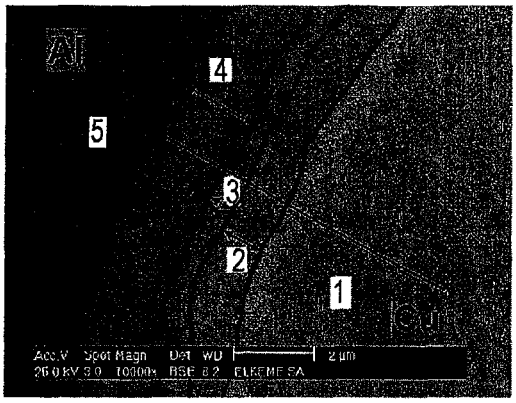

FIG. 4A is a picture made by a scanning electron microscope and showing the inner structure of a seamless composite metal tube according to a first example of the invention.

Figure 4B:
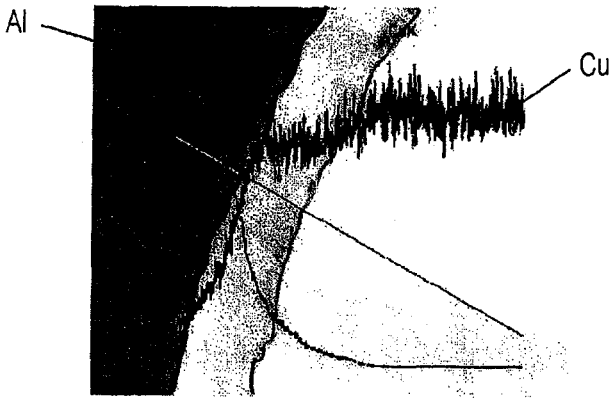

FIG. 4B is a picture showing the distribution of copper and aluminum across intermediate intermetallic layers of the seamless composite metal tube according to the first example of the invention.

Figure 5A:
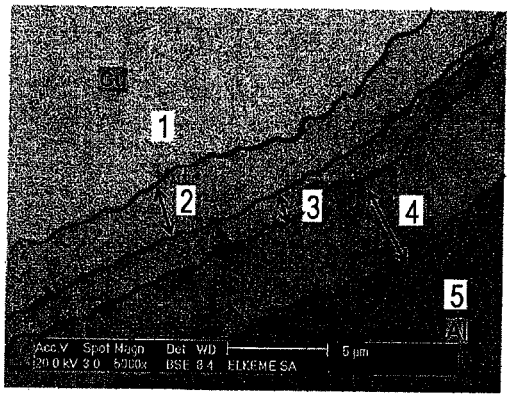

FIG. 5A is a picture made by a scanning electron microscope and showing the inner structure of a seamless composite metal tube according to a second example of the invention.

Figure 5B:
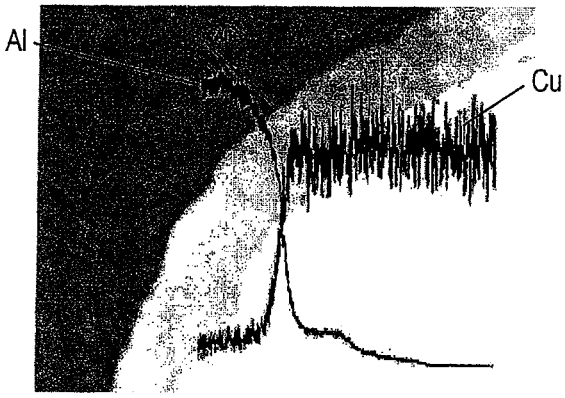

FIG. 5B is a picture showing the distribution of copper and aluminum across intermediate intermetallic layers of the seamless composite metal tube according to the second example of the invention.

Figure 6A:
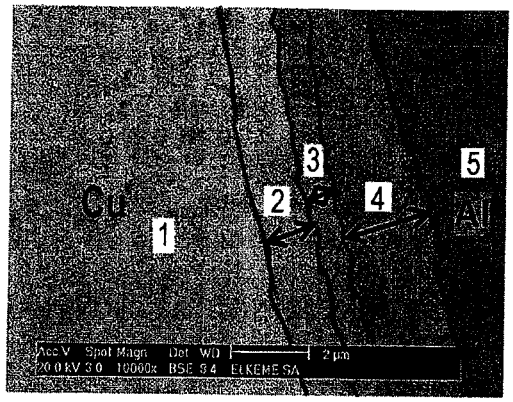

FIG. 6A is a picture made by a scanning electron microscope and showing the inner structure of a seamless composite metal tube according to a third example of the invention.

Figure 6B:
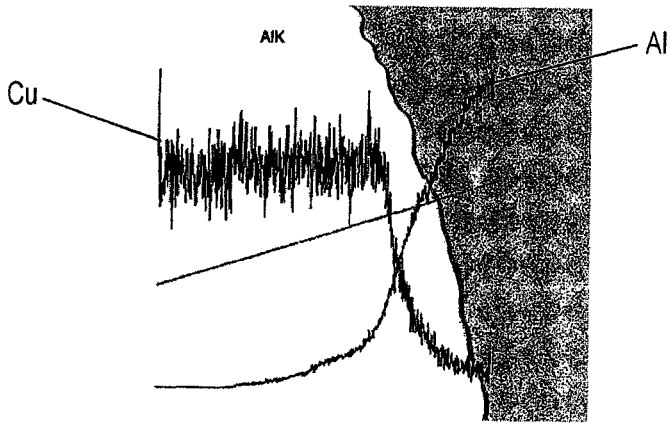

FIG. 6B is a picture showing the distribution of copper and aluminum across intermediate intermetallic layers of the seamless composite metal tube according to the third example of the invention.

Figure 7:
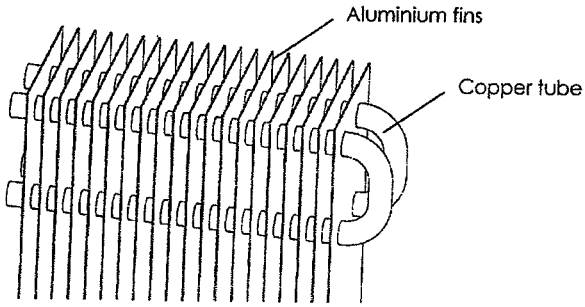

FIG. 7 shows an example of use of the seamless composite metal tube of the invention in a heat-exchanger coil.

Figure 8:
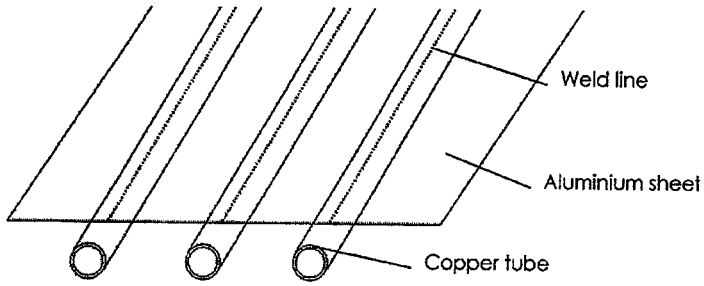

FIG. 8 shows an example of use of the seamless composite metal tube of the invention in a flat solar absorber.

Figure 9:
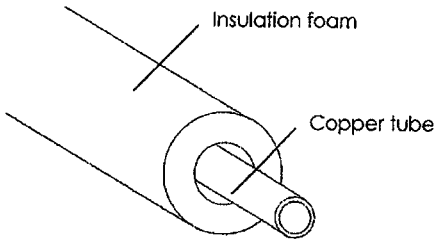

FIG. 9 shows an example of use of the seamless composite metal tube of the invention as a connecting tube for air-conditioning systems.

Figure 1:
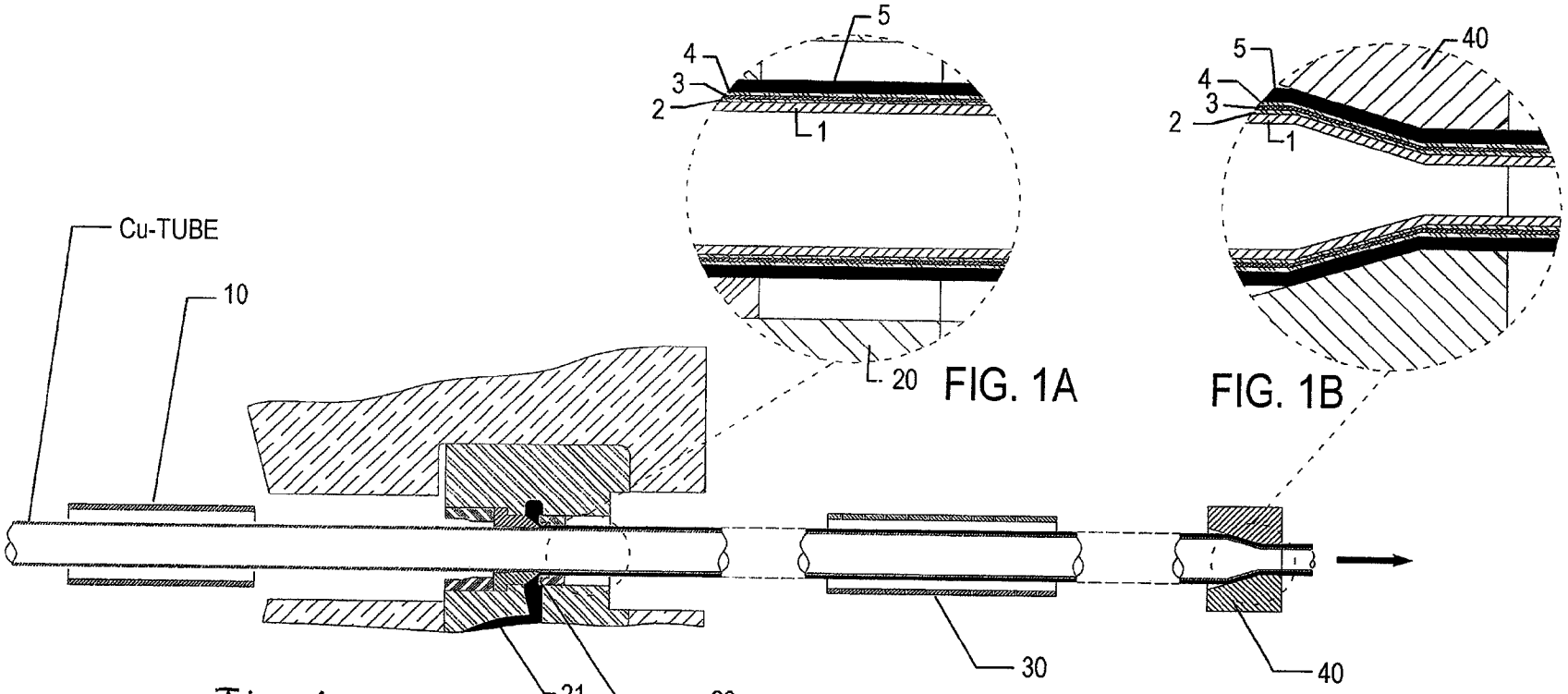
FIG. 1 is a schematic drawing showing the basic structure of an apparatus for producing a seamless composite metal tube according to the invention.

At first, the apparatus for producing a seamless composite metal tube according to the invention and for carrying out the method of manufacturing according to the invention is explained with reference to FIG. 1.

Basically, the apparatus comprises a surface activation device 10, an aluminum extrusion die 20, a cooling device 30 and a reducing device 40, 50, arranged in this order. The surface activation device 10 is a tube-shaped device through the interior of which a tube can be passed for heat-activating the same. Specifically, the surface activation device 10 is able to heat an outer surface of a tube passed through its interior by induction heating under a protective atmosphere (preferably a nitrogen atmosphere). The temperature within the surface activation device 10 can be set in a range from 350° to 450° C.

The extrusion die 20 is a compression die, as e.g. disclosed in PCT/EP2007/53907. An aluminum material is fed through individual channels 21 to the die-head and can be extruded as a tubular layer of aluminum directly onto an outer surface of a tube being passed through the interior of the die-head, as shown in FIG. 1. The extrusion temperature of aluminum material at the die-head can be set in a temperature range between 400 to 550° C.

The cooling device 30 is a cooling tube comprising internal water spray nozzles and/or water spray passages by means of which water can be sprayed on the outer surface of a tube, when this tube is passed through the cooling device 30. The cooling device 30 may have any other configuration, such as a water bath. The cooling device 30 is able to cool down a tube to below 80° C. within a certain cooling time and at a certain cooling rate, respectively.

The reducing device 40, 50 is a diameter reducing die or a diameter and wall thickness reducing die, by means of which the outer diameter or the outer diameter and wall thickness of a tube can be reduced by cold working. FIGS. 1 and 1B show a diameter reducing die 40, and FIG. 10 shows a diameter and wall thickness reducing die 50.

In the following, the basic steps of the method of manufacturing a seamless composite metal tube according to the invention are described with respect to the apparatus of FIG. 1.

A seamless copper tube which has been produced in advance is passed through the surface activation device 10. While passing through the surface activation device 10, the outer surface of the copper tube is heat activated. In particular, the outer surface is heated to a temperature in a range from 350 to 450° C. The energy that is transferred to the copper tube leads to metallurgical changes in the grain size (enlargement of grains) which improves the diffusion between the copper and aluminum in the next steps. After the heat-activation of the outer surface of the copper tube, the copper tube is fed through the interior of the aluminum extrusion die 20. While the copper tube is being passed through the extrusion die, an aluminum layer is extruded from the die-head of the aluminum extrusion die surrounding the copper tube directly onto the outer surface of the copper tube. By this direct extrusion of an aluminum layer around the entire circumference of the copper tube, a composite metal tube is produced. Here, when the hot surface of the pre-activated copper tube comes into contact with the hot aluminum layer at the exit of the extrusion-head, intermediate intermetallic layers are formed between the inner copper layer and the outer aluminum layer.

FIG. 1A shows the basic structure of the produced composite metal tube right after the aluminum layer has been extruded onto the copper tube. As can be seen from FIG. 1A, the produced composite metal tube comprises an inner copper layer 1, three different intermediate intermetallic layers 2, 3, 4, and an outer aluminum layer 5. The intermetallic layers 2, 3, 4 are separate zones and ensure a high bonding strength between the inner copper layer 1 and the outer aluminum layer 5. In particular, each of the intermediate intermetallic layers 2, 3, 4 has a different phase composition, so that there is a discrete concentration step of aluminum and copper between each layer.

Figure 1C:
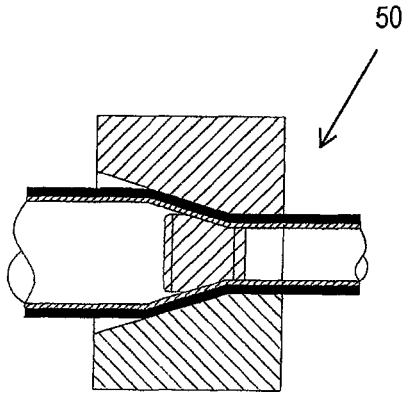
FIG. 1C shows a diameter and wall thickness reducing die.

Then, the produced composite metal tube is passed through the cooling device 30, which cools down the produced composite metal tube, preferably within a cooling time between 5 to 60 sec, to below 80° C. for further processing. Finally, the outer diameter or the outer diameter and wall thickness of the produced composite metal tube is reduced in the reducing device 40, 50 to the desired diameter, as illustrated in FIG. 1B, or to the desired diameter and the desired wall thickness, as illustrated in FIG. 1C.

Figure 2:
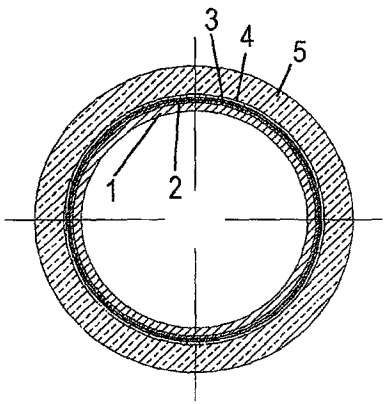
FIG. 2 is a cross-sectional view of the produced seamless composite metal tube, schematically showing its inner structure.

The result is a seamless composite metal tube having a structure as shown in FIGS. 2 and 3, i.e. a tube having an inner layer of copper 1, three different intermediate intermetallic layers 2, 3, 4 and an outer layer of aluminum 5.

EXAMPLES

Next, specific examples for producing a seamless composite metal tube according to the invention by means of the above apparatus for producing a seamless composite metal tube are described.

Example 1

Example 1 refers to the manufacturing of a seamless composite metal tube typically used for HVAC&R applications, especially for use in a heat-exchanger coil.

At first, a seamless copper tube is provided (a copper tube manufactured by extrusion) having an outside diameter of 20.70 mm and a wall thickness of 0.40 mm. This copper tube is then passed through the surface activation device 10 under a corrosion protective atmosphere of nitrogen. The copper tube exits the surface activation device 10 having a surface temperature of 380° C.

Then, aluminum material is continuously fed to the diehead of the extrusion die 20 via the individual channels 21, and is extruded at a temperature of 440° C. directly onto the outer surface of the copper tube which is simultaneously passed through the interior of the extrusion die 20, thereby producing a seamless composite metal tube. The aluminum tubular layer formed as a result of this extrusion on the outer surface of the copper tube has an outside diameter of 21.60 mm and a wall thickness of 0.45 mm. The seamless composite metal tube produced by the extrusion process, therefore, has an outside diameter of 21.60 mm and a wall thickness of 0.85 mm.

Subsequently, the produced composite metal tube is passed through the cooling device 30, where it is cooled down from 440° C. to 80° C. by means of water spray and water bath within a cooling time of 10 sec, i.e. at a cooling rate of 36° C./sec.

Finally, the produced composite metal tube is passed through a series of reducing dies 50 as shown in FIG. 10, by which the outer diameter of the composite metal tube is reduced by cold working to 7.0 mm and the wall thickness is reduced to 0.50 mm.

The resultant composite tube has the inner structure shown in FIG. 4A. In particular, the composite tube comprises the following layers (conforming to European designation EN AW 1070):

- an inner layer (inner tube) 1 having a thickness of approximately 240 μm and comprising 99.90 wt % of copper,
- an inner intermediate intermetallic layer 2 having a thickness of 0.9 μm and comprising 83 wt % of copper and 17 wt % of aluminum (copper and aluminum are in the γ-phase),
- a middle intermediate intermetallic layer 3 having a thickness of 0.5 μm and comprising 72 wt % of copper and 28 wt % of aluminum (copper and aluminum being in the η-phase),
- an outer intermediate intermetallic layer 4 having a thickness of 1.9 μm and comprising 53 wt % of copper and 47 wt % of aluminum (copper and aluminum being in the θ-phase), and
- an outer layer (outer tube) 5 having a thickness of approximately 260 μm and comprising 99.70 wt % of aluminum.

FIG. 4B shows the distribution of copper and aluminum across the above-mentioned intermediate layers.

Example 2

Example 2 refers to the manufacturing of a seamless composite metal tube typically used for solar panel applications, especially for use in a flat solar absorber.

At first, a seamless copper tube is provided (a copper tube manufactured by extrusion) having an outside diameter of 20.70 mm and a wall thickness of 0.40 mm. This copper tube is then passed through the surface activation device 10 under a corrosion protective atmosphere of nitrogen. The copper tube exits the surface activation device 10 having a surface temperature of 420° C.

Then, aluminum material is continuously fed to the diehead of the extrusion die 20 via the individual channels 21, and is extruded at a temperature of 500° C. directly onto the outer surface of the copper tube which is simultaneously passed through the interior of the extrusion die 20, thereby producing a seamless composite metal tube. The aluminum tubular layer formed as a result of this extrusion on the outer surface of the copper tube has an outside diameter of 22.60 mm and a wall thickness of 0.95 mm. The seamless composite metal tube produced by the extrusion process, therefore, has an outside diameter of 22.60 mm and a wall thickness of 1.35 mm.

Subsequently, the produced composite metal tube is passed through the cooling device 30, where it is cooled down from 500° C. to 80° C. by means of water spray and water bath within a cooling time of 30 sec, i.e. at a cooling rate of 14° C./sec. Finally, the produced composite metal tube is passed through a series of reducing dies 50 as shown in FIG. 1C, by which the outer diameter of the composite metal tube is reduced by cold working to 10.0 mm and the wall thickness is reduced to 0.50 mm.

The resultant composite tube has the inner structure shown in FIG. 5A. In particular, the composite tube comprises the following layers (conforming to European designation EN AW 1070):

- an inner layer (inner tube) 1 having a thickness of approximately 150 μm and comprising 99.90 wt % of copper,
- an inner intermediate intermetallic layer 2 having a thickness of 2.0 μm and comprising 82 wt % of copper and 18 wt % of aluminum (copper and aluminum are in the γ-phase),
- a middle intermediate intermetallic layer 3 having a thickness of 1.4 μm and comprising 71 wt % of copper and 29 wt % of aluminum (copper and aluminum being in the η-phase),
- an outer intermediate intermetallic layer 4 having a thickness of 4.1 μm and comprising 53 wt % of copper and 47 wt % of aluminum (copper and aluminum being in the θ-phase), and
- an outer layer (outer tube) 5 having a thickness of approximately 350 μm and comprising 99.50 wt % of aluminum.

FIG. 5B shows the distribution of copper and aluminum across the above-mentioned intermediate layers.

Example 3

Example 3 refers to the manufacturing of a seamless composite metal tube typically used as a connecting tube for air-conditioning systems.

At first, a seamless copper tube is provided (a copper tube manufactured by extrusion) having an outside diameter of 20.70 mm and a wall thickness of 0.40 mm. This copper tube is then passed through the surface activation device 10 under a corrosion protective atmosphere of nitrogen. The copper tube exits the surface activation device 10 having a surface temperature of 370° C.

Then, aluminum material is continuously fed to the die-head of the extrusion die 20 via the individual channels 21, and is extruded at a temperature of 460° C. directly onto the outer surface of the copper tube which is simultaneously passed through the interior of the extrusion die 20, thereby producing a seamless composite metal tube. The aluminum tubular layer formed as a result of this extrusion on the outer surface of the copper tube has an outside diameter of 22.50 mm and a wall thickness of 0.88 mm. The seamless composite metal tube produced by the extrusion process, therefore, has an outside diameter of 22.50 mm and a wall thickness of 1.28 mm.

Subsequently, the produced composite metal tube is passed through the cooling device 30, where it is cooled down from 460° C. to 80° C. by means of water spray and water bath within a cooling time of 10 sec, i.e. at a cooling rate of 38° C./sec. The dwell time between the extrusion step and the cooling step is in this example about 10 seconds.

Finally, the produced composite metal tube is passed through a series of reducing dies 50 as shown in FIG. 1C, by which the outer diameter of the composite metal tube is reduced by cold working to 9.525 mm and the wall thickness is reduced to 0.80 mm.

The resultant composite tube has the inner structure shown in FIG. 6A. In particular, the composite tube comprises the following layers (conforming to European designation EN AW 1070):

- an inner layer (inner tube) 1 having a thickness of approximately 250 μm and comprising 99.90 wt % of copper,
- an inner intermediate intermetallic layer 2 having a thickness of 1.1 μm and comprising 79 wt % of copper and 21 wt % of aluminum (copper and aluminum are in the γ-phase),
- a middle intermediate intermetallic layer 3 having a thickness of 0.6 μm and comprising 72 wt % of copper and 28 wt % of aluminum (copper and aluminum being in the η-phase),
- an outer intermediate intermetallic layer 4 having a thickness of 2.3 μm and comprising 53 wt % of copper and 47 wt % of aluminum (copper and aluminum being in the θ-phase), and
- an outer layer (outer tube) 5 having a thickness of approximately 550 μm and comprising 99.50 wt % of aluminum.

FIG. 6B shows the distribution of copper and aluminum across the above-mentioned intermediate layers.

Examples of Preferable Use

The seamless composite metal tube according to the invention satisfies the technical requirements of applications related to the transportation of fluids and provides a substantial cost benefit due to the relatively lower cost of aluminum compared to copper.

The seamless composite metal tube according to the invention also eliminates the phenomenon of galvanic corrosion in applications where copper and aluminum are connected in the presence of an electrolyte.

Typical examples of use where the seamless composite metal tube according to the invention shows increased benefit include the following:

1. Use in a heat-exchanger coil for HVAC (Heating, Ventilation & Air-Conditioning) applications Traditionally, a heat-exchanger coil for HVAC (Heating, Ventilation & Air-Conditioning) applications is made of copper tube and aluminum fins. A standard condenser coil positioned on the outside of the premises is manufactured from rows of copper tubes running through aluminum fins, as shown in FIG. 7. The copper tubes are mechanically enlarged inside the fins in order to make contact. This connection/contact leads to a couple between dissimilar metals. Because copper and aluminum are very dissimilar metals with high potential of corrosion, the presence of an electrolyte at the copper-tube and aluminum-fin couple is sufficient to initiate a corrosion reaction. Common electrolytes could include rain water mist, rain water droplets, sea spray, or other solutions containing sodium or calcium chloride compounds, or even, sulfur and nitrogen compounds.

Galvanic corrosion in fin-and-tube coils causes the degradation of the aluminum fins (aluminum being the anode), which leads to reduced thermal efficiency of the coil because of the loss of contact between the fin and the tube. In more severe cases, galvanic corrosion may lead to leaks and ultimately destruction of the entire coil.

Using the seamless composite metal tube according to the invention instead of the copper tube eliminates the bi-metallic couple in the coil construction. This is accomplished by the external layer of the composite metallic tube made of aluminum. The aluminum layer is directly connected mechanically to the aluminum fins and creates a barrier between the inside copper layer and the electrolyte to prevent galvanic corrosion.

2. Use in a Flat Solar Absorber

In generally, a flat solar absorber is positioned inside a glazed solar collector panel. Traditionally, a flat solar absorber is made of copper tubes and an aluminum sheet. Specifically, copper tubes are welded onto a specially-coated aluminum sheet, as shown in FIG. 8. Solar rays heat up the aluminum sheet and the heat is transferred to the copper tube through the welding contact which in turn heats up the water flowing inside the tube. Operating temperatures may reach as high as 200° C.

This design is prone to galvanic corrosion problems because of the welding of dissimilar materials. If the solar collector is not properly insulated from the outside environment, then rain water may enter inside and act as an electrolyte. Because of the high temperatures involved the galvanic corrosion may be accelerated.

Using the seamless composite metal tubes according to the invention instead of the copper tubes enables the joining of similar materials, i.e. the aluminum sheet welded to the outside aluminum layer of the composite metal tube. The benefit is twofold. The possibility of galvanic corrosion is entirely avoided while welding is facilitated due to the compatibility of the sheet material and the outer tube layer. As the same time, the internal copper layer ensures that the flowing water does not corrode the system and guarantees a long lifetime of the collector.

3. Use as a Connecting Tube for Split-Type Air-Conditioning Systems

The composite metal tube according the invention can be used as a connection tube for split-type air-conditioning systems.

A connecting tube (shown in FIG. 9) for air-conditioning systems enables the connection of the outside heat-exchanger coil with the heat-exchanger coil placed inside the premises. It must be flexible enough to allow easy installation while strong enough to withstand the inside pressure of the system. Moreover, the material must be chemically compatible with the refrigerants that flow inside the tube. Normally, the tube is insulated with foam in order to minimize thermal losses of the system. Traditionally the tube is made of copper because it meets all the design criteria, as well as, because of its high corrosion resistance to the chemical refrigerants used by the air-conditioning industry.

The composite metal tube according the invention meets all design criteria and is fully compatible with the refrigerant fluid. The use of the composite metal tube according the invention offers an economic benefit because of the relatively lower cost of the aluminum compared to copper.

The invention claimed is:

1. A seamless composite metal tube comprising an inner layer consisting of copper or a copper alloy, an outer layer consisting of aluminium or an aluminium alloy, and at least three different intermediate intermetallic layers each consisting of copper and aluminium, wherein the concentration of copper decreases from the inner layer to the outer layer in the radial direction of the tube.

2. The seamless composite metal tube according to claim 1, wherein the inner intermediate intermetallic layer comprises 79-85 wt % of copper and 21-15 wt % of aluminium, the middle intermediate intermetallic layer comprises 69-73 wt % of copper and 31-27 wt % of aluminium, and the outer intermediate intermetallic layer comprises 50-55 wt % of copper and 50-45 wt % of aluminium.

3. The seamless composite metal tube according to claim 1, wherein the inner intermediate intermetallic layer consists of copper and aluminium being in the γ-phase, the middle intermediate intermetallic layer consists of copper and aluminium being in the η-phase, and the outer intermediate intermetallic layer consists of copper and aluminium being in the θ-phase.

4. The seamless composite metal tube according to of claim 1, wherein each of the intermediate intermetallic layers has a thickness in the radial direction of the tube between 0.5 μm to 4.0 μm, and/or the sum of the thicknesses of the intermediate intermetallic layers in the radial direction of the tube is between 1.5 μm to 12 μm.

5. The seamless composite metal tube according to claim 1, wherein the thickness of the outer intermediate intermetallic layer is at least twice as much as the thickness of the inner intermediate intermetallic layer in the radial direction of the tube.

6. The seamless composite metal tube according to claim 1, wherein the thickness ratio of the inner layer and the outer layer in the radial direction of the tube is between 0.1 and 0.8.

7. A method of manufacturing a seamless composite metal tube comprising the steps of:

heat-activating the outer surface of a seamless tube made of copper or a copper alloy, and extruding a tubular layer of aluminium or an aluminium alloy directly onto the heat-activated outer surface of the seamless tube made of copper or a copper alloy thereby producing a seamless composite metal tube.

8. Method according to claim 7, wherein the produced seamless composite metal tube is a seamless composite metal tube comprising an inner layer consisting of copper or a copper alloy, an outer layer consisting of aluminium or an aluminium alloy, and at least three different intermediate intermetallic layers each consisting of copper and aluminium, wherein the concentration of copper decreases from the inner layer to the outer layer in the radial direction of the tube.

9. The method according to claim 7, wherein the step of extruding is performed by continuously passing the seamless tube made of copper or a copper alloy through an extrusion die and continuously extruding the tubular layer of aluminium or an aluminium alloy by means of the extrusion die.

10. The method according to claim 7, wherein the temperature of the heat-activated outer surface is between 350 degrees to 450 degrees C.

11. The method according to claim 7, wherein the heat-activating is performed by induction heating under a protective atmosphere.

12. The method according to claim 7, wherein the extrusion temperature of the aluminium or aluminium alloy is between 400 degrees to 550 degrees C.

13. The method according to claim 7, further comprising, subsequent to the step of extruding, the step of cooling the composite metal tube by forced convection.

14. The method according to claim 13, wherein a cooling time is set in a range from 5 to 60 sec.

15. The method according to claim 13, further comprising, subsequent to the step of cooling, the step of passing the composite metal tube through a diameter reducing device or a diameter and wall thickness reducing device for reducing its outer diameter or its outer diameter and wall thickness by cold working.

16. The method according to claim 7, wherein the heat-activating is performed by induction heating under a protective nitrogen atmosphere.

17. The method according to claim 7, further comprising:

subsequent to the step of extruding, the step of cooling the composite metal tube by forced convection by means of a cooling tube comprising internal fluid spray nozzles and/or fluid spray passages for spraying water onto the composite metal tube when being passed through the interior of the cooling tube.

18. The method according to claim 7, further comprising:

subsequent to the step of extruding, the step of cooling the composite metal tube by forced convection by means of a cooling tube comprising internal fluid spray nozzles and/or fluid spray passages for spraying water onto the composite metal tube when being passed through the interior of the cooling tube, wherein the composite metal tube is cooled down to below 80 degrees C.

19. The method according to claim 13, wherein a cooling rate is between 5 to 100 degrees C./sec.

* * * * *